US009185933B2

(12) United States Patent
Wardecki

(10) Patent No.: US 9,185,933 B2
(45) Date of Patent: Nov. 17, 2015

(54) VALVE UNIT FOR FILLING ANGULAR TRANSPORT CHANNELS WITH MASS FLOW OF ROD LIKE ARTICLES

(75) Inventor: Wojciech Wardecki, Radom (PL)

(73) Assignee: INTERNATIONAL TOBACCO MACHINERY POLAND SP. ZO.O, Radom (PL)

( * ) Notice: Subject to any disclaimer, the term of this patent is extended or adjusted under 35 U.S.C. 154(b) by 3 days.

(21) Appl. No.: 14/236,296

(22) PCT Filed: Aug. 1, 2012

(86) PCT No.: PCT/PL2012/000061

§ 371 (c)(1),
(2), (4) Date: Jan. 30, 2014

(87) PCT Pub. No.: WO2013/019131

PCT Pub. Date: Feb. 7, 2013

(65) Prior Publication Data

US 2014/0158498 A1 Jun. 12, 2014

(30) Foreign Application Priority Data

Aug. 2, 2011 (PL) ..... 395838

(51) Int. Cl.
*B65G 1/00* (2006.01)
*A24C 5/35* (2006.01)

(52) U.S. Cl.
CPC ..... *A24C 5/35* (2013.01)

(58) Field of Classification Search
CPC ..... B65G 47/5113; A24C 5/35
USPC ..... 198/347.1, 364, 367, 368
See application file for complete search history.

(56) References Cited

U.S. PATENT DOCUMENTS 3,565,237 A * 2/1971 Strydom ..... 198/572
4,365,703 A * 12/1982 Hinchcliffe et al. ..... 414/413

(Continued)

FOREIGN PATENT DOCUMENTS

EP 1 454 543 A1 9/2004
FR 1 502 715 11/1967

(Continued)

OTHER PUBLICATIONS

International Search Report dated Jan. 24, 2013 issued in corresponding application No. PCT/PL2012/000061.

(Continued)

*Primary Examiner* — William R Harp
(74) *Attorney, Agent, or Firm* — Westerman, Hattori, Daniels & Adrian, LLP

(57) ABSTRACT

An angular channel (6) is disposed between principally horizontal, upper (2) and lower (7, 71) conveyors, whereas along one side wall (9) of the channel (6) is disposed a guide (14) to which a first rotatable valve element (10) is slidably mounted. At the outlet of the channel (6), at the other, opposite side wall (19), is stationary mounted together with a pneumatic actuator (22), a second rotatable valve element (20) which chronologically works together with the first element (10), whereas the first element (10) is attached to the guide (14) by means of a slider (13). The first valve element (10) has three operating positions, whereas in the first position it is set principally horizontally at the inlet of the channel (6), and in the second position it is set slantwise, preferably at an angle of 45°, at the outlet of the channel (6), and in the third position it is set principally horizontally next to the channel (6). The second valve element (20) has two operating positions, whereas in the first position it is set slantwise, preferably at an angle of 45°, at the outlet of the channel (6), and in the second position it is set principally horizontally next to the channel (6). The first element (10) in the second operating position is pushed with its end close to the end of the second element (20) set in the first position. A reciprocating motion of the slider (13) is provided by a motor (17) connected with the slider (13) by means of a pull rod (18). The valve elements (10, 20) have the form of a solid having one, circularly concave or flat, working surface (11, 21).

14 Claims, 4 Drawing Sheets

(56) References Cited

U.S. PATENT DOCUMENTS

| | | | | |
|---|---|---|---|---|
| 5,217,101 | A | 6/1993 | Raschka | |
| 6,540,061 | B1 * | 4/2003 | Focke et al. | 198/359 |
| 6,675,952 | B1 * | 1/2004 | Hannebauer et al. | 198/532 |
| 7,044,286 | B2 * | 5/2006 | Sikora et al. | 198/457.05 |
| 8,322,511 | B2 * | 12/2012 | Leifheit | 198/347.1 |
| 8,327,996 | B2 * | 12/2012 | Gielniewski et al. | 198/347.1 |

FOREIGN PATENT DOCUMENTS

| | | | | |
|---|---|---|---|---|
| GB | 2104858 A | * | 3/1983 | B65G 47/52 |
| WO | 02/096227 A2 | | 12/2002 | |

OTHER PUBLICATIONS

Written Opinion of the International Searching Authority dated Jan. 24, 2013 issued in corresponding application No. PCT/PL2012/000061.

* cited by examiner

VALVE UNIT FOR FILLING ANGULAR TRANSPORT CHANNELS WITH MASS FLOW OF ROD LIKE ARTICLES

BACKGROUND OF THE INVENTION

The object of the invention is a valve unit for initial filling of near-vertical angular transport channels with mass flow in the transfer systems of rod like articles used in the tobacco industry.

In the production lines of rod like articles of the tobacco industry, such as cigarettes, filters or cigarettes with the filter already stuck on, in the course of the production process said products cover a considerable distance after leaving the manufacturing machine before they are placed into packages in the packaging machine or into the stores. They are usually conveyed in a multilayered ordered stack, which eliminates the deformation or damages. There is a need of handling the stream of articles for the purpose of delivering to or from different devices used in the production line. For this purpose, on the path of horizontal conveyors transferring the products, near-vertical angular channels connecting one horizontal conveyor or hopper with another horizontal conveyor or a receiving device are formed. Rod like articles completely fill the near-vertical angular channels and principally horizontal conveyors, which is a condition determining the preservation of their arrangement. The transfer on a horizontal path is usually forced, whereas the transfer in angularly situated channels is usually effected by gravity. Said handling of the flow many times consists in cutting off the angular channel in which the articles flow or in directing the stream of articles to another receiving device, with the necessary condition being that the rod like articles are as little damaged as possible when handling the flow. An important problem to be solved is gentle feeding of a stack of articles into the earlier emptied angular channel, for instance in case of a change of the range of articles, so that they are not damaged. In order to achieve the said aim, initial filling of the angular channel is frequently carried out by hand, using a blocking element placed earlier into the channel. In the description of the U.S. Pat. No. 6,540,061 a method and an apparatus for transporting cigarettes are presented; in one of the embodiments thereof, shown in FIG. 10 of the drawing, a vertical channel connecting an upper horizontal conveyor with a lower horizontal conveyor was disclosed. Next to the channel, a guide is disposed on which a trolley guiding a plate closing the inside diameter of the channel moves. Before the commencement of filling of the channel with rod like articles, the plate is situated at the end of the upper horizontal conveyor close to a filling sensor. A signal from the sensor indicating that the upper conveyor is filled causes the activation of the trolley, and the plate moves down the channel, holding the front face of the mass flow. After reaching the lower horizontal conveyor, the plate is deflected so that it constitutes a fragment of an upper wall of said conveyor and does not hinder continued movement of the mass flow on the lower conveyor. If the sensor disposed in the lower conveyor detects the absence of mass flow, the plate is again inserted into the inside diameter of the lower conveyor and transferred by the activated trolley as far as the upper conveyor where it waits for the front face of the mass flow. On the other hand, in the description of the application for the European Patent no. EP 1.704.787 a method and an apparatus to control the filling of cigarette feeding channels, in particular during the first filling of the packaging machine, was disclosed. The apparatus has two angularly situated channels, each of which is provided with a guiding member slidably mounted in a side wall of the channel. In the bottom part of said wall a niche is situated which can contain the guiding member, after earlier turning, in order to fully open the channel. In the course of the first filling the member moves down, holding the front face of the mass flow of cigarettes, and at the final stage hides in the niche, whereas its role in the further part of the channel is taken over by flexible members. A slightly different solution was presented in the description of the U.S. Pat. No. 4,572,352 where the angular channel connecting un upper horizontal conveyor with a lower horizontal conveyor is closed with a flexible valve element which under the pressure of rod like articles flowing in the upper conveyor progressively takes the shape of an angular channel, facilitating gentle feeding of the articles into the lower conveyor.

SUMMARY OF THE INVENTION

The object of the invention is the construction of a valve unit for initial filling of a near-vertical, angular channel transporting the mass flow of rod like articles used in the tobacco industry, whereas an angular channel is disposed between an upper, principally horizontal, conveyor or a hopper and a lower, principally horizontal, conveyor or a receiving device, and along one side wall of the channel is disposed a guide to which a first rotatable valve element, making a reciprocating motion between the channel inlet and outlet, is slidably mounted. According to the invention, at the outlet of the channel, at the other, opposite side wall, is stationary mounted, together with a pneumatic actuator, a second rotatable valve element, whereas the said second element chronologically works together with the first rotatable valve element which is attached to a guide together with the pneumatic actuator by means of a slider. The first rotatable valve element has three operating positions, whereas in the first operating position it is set principally horizontally at the channel inlet, in the second operating position it is set slantwise, preferably at an angle of 45°, at the channel outlet, and in the third operating position it is set principally horizontally next to the channel. The second rotatable valve element has two operating positions, whereas in the first operating position it is set slantwise, preferable at an angle of 45°, at the channel outlet, and in the second operating position it is set principally horizontally next to the channel. The first valve element in the second operating position is pushed with its end close to the end of the second valve element set in the first operating position so that both elements close the channel outlet. The reciprocating motion of the slider together with the first rotatable valve element and the pneumatic actuator is provided by a motor connected with the slider by means of a pull rod. The first and the second rotatable valve elements have the form of a solid having one working surface, circularly concave or flat. Such construction permits to steer the mass flow in any direction in the lower horizontal conveyor, and in addition allows automatic initial filling of the channels when starting the production line, for instance after changing the range of manufactured articles, without the need of manual arrangement of rod like articles forming the mass flow or the use of provisional plugs, whereas the height of the angular channel is not important because no risk of occurrence of a gap in the mass flow exists.

BRIEF DESCRIPTION OF THE DRAWINGS

The object of the invention has been shown in an embodiment in a drawing in which.

DETAILED DESCRIPTION OF THE INVENTION

Figure 1:
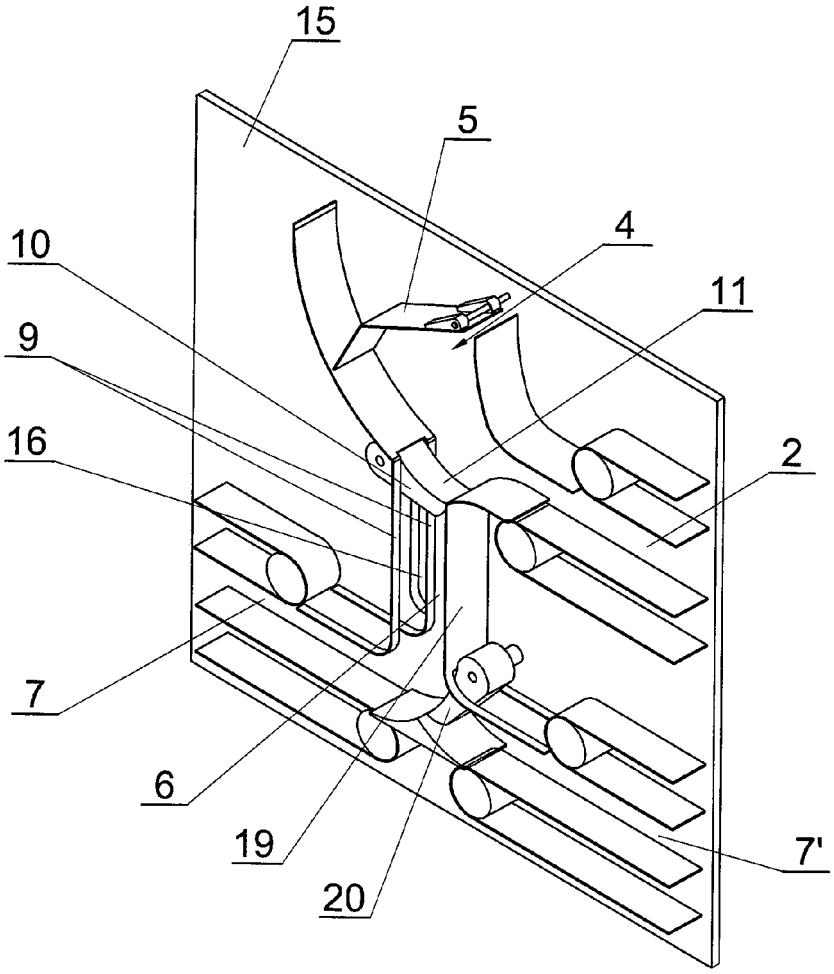
FIG. 1 shows a fragment of a system for transporting the mass flow of rod like articles in a perspective view, FIG. 2—a simplified front view of the system of FIG. 1 with the first and the second rotatable valve elements in the first operating position, FIG. 3—a simplified rear view of the system of FIG. 2, and FIG. 4—successive phases of the mass flow in the system for different positions of the valve unit.
Figure 2:
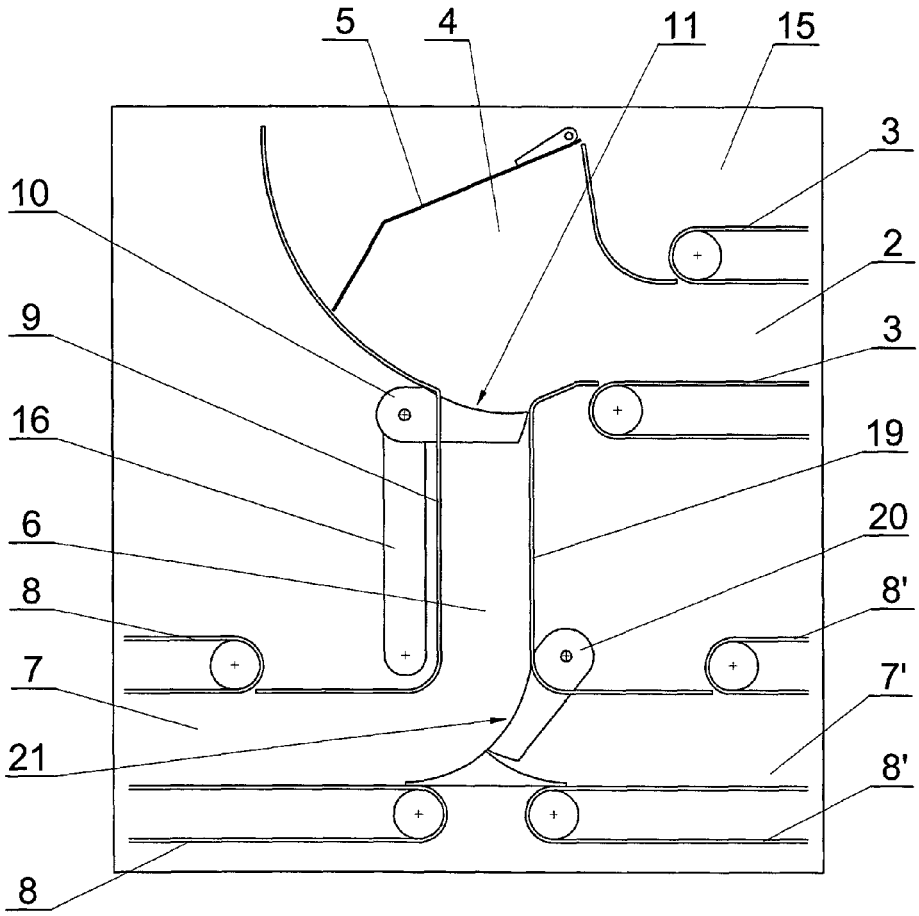
Figure 3:
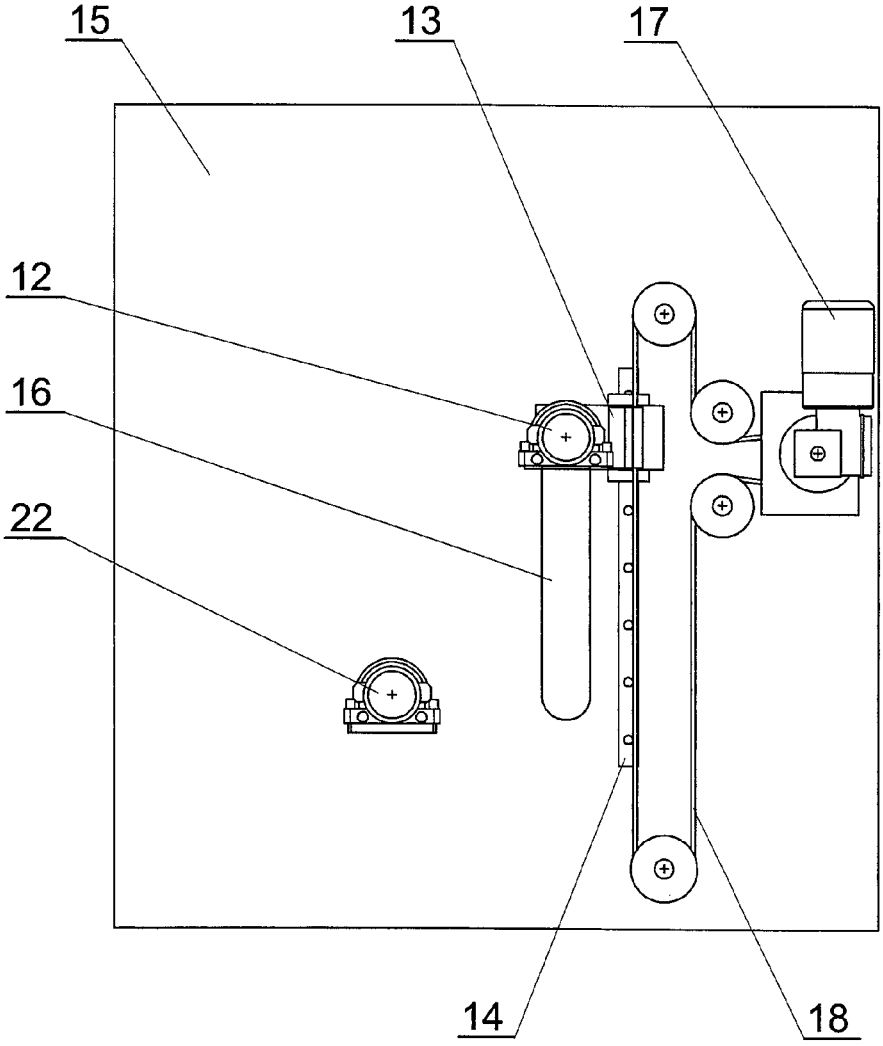

The shown fragment of a system for transporting the mass flow of rod like articles 1 comprises an upper horizontal conveyor 2, in which the motion of the articles 1 is forced by movable belts 3, ending with a hopper 4 above which is disposed a selfaligning rocker arm 5 adjusting its position to the amount of accumulated rod like articles, provided with a filling sensor. Beneath the hopper 4 is situated an angular channel 6, principally perpendicular to the horizontal conveyor 2, and beneath the channel 6, on both sides thereof, extends a lower horizontal conveyor 7 and 7' wherein the motion of the articles 1 is forced by moving tapes 8 and 8'. One side wall 9 of the channel 6 consists of two parts, and in the gap between the parts of the wall 9 moves a first rotatable valve element 10 in the form of a solid constituting a plate with a circularly concave or optionally flat working surface 11. The element 10 is attached to a pneumatic actuator 12, and the actuator 12 is fastened to a slider 13 slidably mounted on a guide 14 disposed on the back side of a frame 15, whereas the guide 14 is parallel to the side wall 9. The first valve element 10 together with the actuator 12 moves in a gap 16 formed in the frame 15, parallel to the wall 9 of the channel 6. The reciprocating motion of the slider 13 is provided by a motor 17 also attached on the back side to the frame 15 and connected with the slider 13 by means of a pull rod 18. The other side wall 19 of the channel 6 is full, and at its bottom end is disposed a second rotatable valve element 20 in the form of a solid constituting a plate with a circularly concave or optionally flat working surface 21, whereas the element 20 is disposed on a pneumatic actuator 22, stationary mounted on the back side of the frame 15. The first rotatable valve element 10 has three operating positions. In the first position it is set horizontally at the inlet on the channel 6 so that the concave working surface 11 constitutes the bottom of the hopper 4. In the second operating position the element 10 is set at an angle of 45° at the outlet of the channel 6, and in the third operating position, occurring optionally, is set horizontally outside of the channel 6 above the lower horizontal conveyor 7. The second rotatable valve element 20 has two operating positions. In the first operating position it is set at an angle of 45° at the outlet of the channel 6, and in the second operating position, occurring optionally, it is set horizontally outside of the channel 6 above the lower horizontal conveyor 7'.

Figure 4:
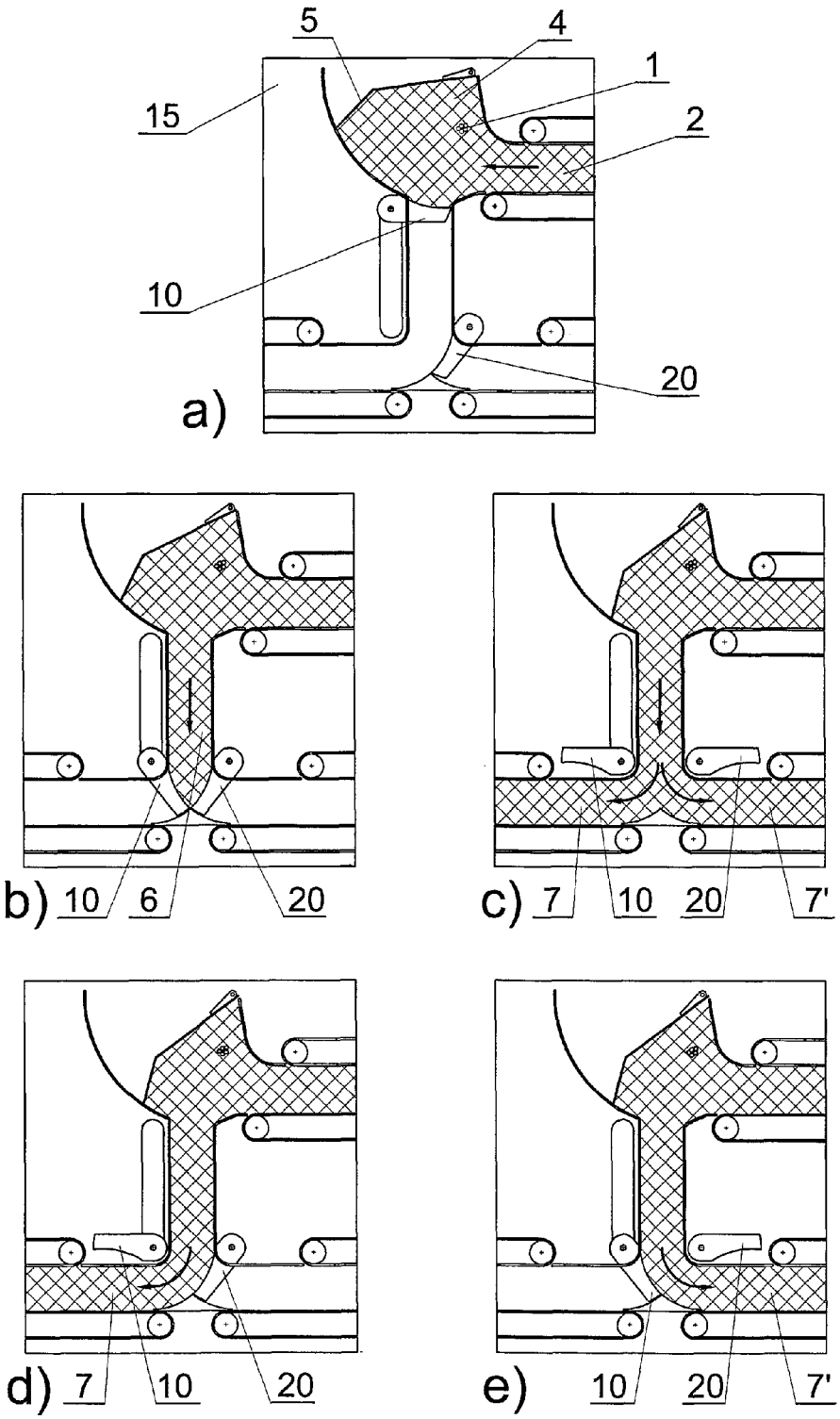

The valve unit works as follows. After filling the hopper 4 with rod like articles 1, which is signaled by a filling sensor of the arm 5 (FIG. 4*a*), the motor 17 is switched on which by means of the pull rod 18 causes gentle lowering of the first valve element 10 together with the actuator 12, whereas the rod like articles 1 situated on the working surface 11 successively fill the inside of the channel 6. After reaching the outlet of the channel 6 the actuator 12 shifts the valve element 10 to the second operating position so that the end of its plate touches the end of the plate of the second valve element 20, set in the first operating position, and the channel 6 is completely filled with the mass flow (FIG. 4*b*). In case of the need of a further transfer of the articles 1 on the conveyors 7 and 7', the first valve element 10 is set with the actuator 12 in the third operating position, and the second valve element is set with the actuator 22 in the second operating position, which facilitates the mass flow assisted by the tapes 8 and 8' (FIG. 4*c*). In case of the need of a further transfer of the articles 1 only in one direction on the conveyor 7, the first valve element 10 is set with the actuator 12 in the third operating position, and the second valve element 20 remains in the first operating position, which facilitates the mass flow assisted by the tapes 8 (FIG. 4*d*). In case of the need of a further transfer of the articles 1 only in one direction on the conveyor 7', the first valve element 10 remains in the second operating position, and the second valve element 20 is set with the actuator 22 in the second operating position, which facilitates the mass flow assisted by the tapes 8' (FIG. 4*e*).

The invention claimed is:

1. A valve unit for transporting mass flow of rod like articles used in the tobacco industry, comprising:

an upper conveyor, disposed substantially horizontally, a lower conveyor, disposed substantially horizontally, and an angular channel disposed between the upper conveyor and the lower conveyor, the angular channel being disposed substantially vertically, and including a first side wall and a second side wall, the angular channel having an inlet and an outlet, a first rotatable valve element disposed along the first side wall of the angular channel, the first rotatable element making a reciprocating motion between channel inlet and outlet, a second rotatable valve element disposed along the second side wall of the angular channel at the channel outlet, wherein the first valve element is attached to a guide which moves reciprocally along a slider, wherein the first valve element is rotated by a first pneumatic actuator, wherein the second valve element is stationary, wherein the second valve element is rotated by a second pneumatic actuator, and wherein the second element chronologically works together with the first rotatable valve element.

2. A valve unit as in claim 1, wherein the first rotatable valve element has three operating positions:

a first operating position which is substantially horizontal in the inlet of the channel, a second operating position which is slantwise in the outlet of the channel, and a third operating position which is substantially horizontal outside of the outlet of the channel.

3. A valve unit as in claim 2, wherein the first rotatable valve element in the second operating position is set slantwise at an angle of 45°.

4. A valve unit as in claim 3, wherein when the first valve element is in the second operating position and the second valve element is in the first operation position, an end of the first valve element is disposed close to an end of the second valve element, so that the first and second valve elements close the outlet of the channel.

5. A valve unit as in claim 1, wherein the second rotatable valve element has two operating position:

a first operating position which is slantwise in the outlet of the channel, and a second operating position which is substantially horizontal outside of the outlet of the channel.

6. A valve unit as in claim 5, wherein the second rotatable valve element in the first operating position is set slantwise at an angle of 45°.

7. A valve unit as in claim 6, wherein when the first valve element is in the second operating position and the second valve element is in the first operation position, an end of the first valve element is disposed close to an end of the second valve element, so that the first and second valve elements close the outlet of the channel.

8. A valve unit as in claim 1 wherein the guide which reciprocally moves on the slider is moved by a motor connected with the slider by a pull rod.

9. A valve unit as in claim 1, wherein the first rotatable valve element is a solid having one working surface.

10. A valve unit as in claim 9, wherein the working surface of the first rotatable valve element is circularly concave.

11. A valve unit as in claim 9, wherein the working surface of the first rotatable valve element is flat.

12. A valve unit as in claim 1, wherein the second rotatable valve element is a solid having one working surface.

13. A valve unit as in claim 12, wherein the working surface of the second rotatable valve element is circularly concave.

14. A valve unit as in claim 12, wherein the working surface of the second rotatable valve element is flat.

* * * * *